US009231349B2

(12) United States Patent
Yang et al.

(10) Patent No.: US 9,231,349 B2
(45) Date of Patent: Jan. 5, 2016

(54) ELECTRICAL CONNECTOR

(71) Applicant: ADVANCED-CONNECTEK INC., New Taipei (TW)

(72) Inventors: Sheng-Ho Yang, New Taipei (TW); Pei-Hsuan Huang, New Taipei (TW); Wen-Yu Wang, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/460,967

(22) Filed: Aug. 15, 2014

(65) Prior Publication Data

US 2015/0349467 A1 Dec. 3, 2015

(30) Foreign Application Priority Data

Aug. 30, 2013 (TW) ..... 102216322 U

(51) Int. Cl.
*H01R 13/648* (2006.01)
*H01R 13/6582* (2011.01)

(52) U.S. Cl.
CPC ..... *H01R 13/6582* (2013.01)

(58) Field of Classification Search
CPC ..... H01R 13/26; H01R 12/724; H01R 23/02; H01R 13/6582
USPC ..... 439/607.4, 607.01, 607.35
See application file for complete search history.

(56) References Cited

U.S. PATENT DOCUMENTS

2010/0240255 A1* 9/2010 He et al. ..... 439/607.35
2013/0252466 A1* 9/2013 Chen ..... 439/607.35

* cited by examiner

*Primary Examiner* — Abdullah Riyami
*Assistant Examiner* — Marcus Harcum
(74) *Attorney, Agent, or Firm* — Steptoe & Johnson LLP

(57) ABSTRACT

An electrical connector is provided, including a main body, first terminals installed at a seat of the main body, second terminals embedded in the seat, and a housing. The housing has a bottom wall, two side walls, and a top wall, and defines an accommodating space having a first opening and a second opening. A plurality of first spring plates are disposed on the top wall and bottom wall. A second spring plate is disposed near the second opening of the top wall. Third spring plates are disposed near the second opening of the bottom wall. When a connector plug is plugged into the electrically connector, the first, second and third spring plates make contact with an iron housing of the connector plug to increase the contact area between the connector plug and the electrical connector, and reduce electromagnetic interference to peripheral devices.

16 Claims, 11 Drawing Sheets

| | P4 | P5 | P6 | P7 | P8 | P9 | P10 |
|---|---|---|---|---|---|---|---|
| | 2.4GHz | 2.4GHz | 2.4GHz | 2.4GHz | 2.4GHz | 2.4GHz | 2.4GHz |
| Prior art | -78.927 | -76.482 | -78.792 | -83.159 | -88.253 | -83.859 | -78.458 |
| The present invention | -79.273 | -77.408 | -79.177 | -83.690 | -92.308 | -88.411 | -79.004 |

FIG. 1G

ELECTRICAL CONNECTOR

BACKGROUND OF THE INVENTION

1. Field of the Invention

The present invention relates to electrical connectors, and, more particularly to an electrical connector for preventing electromagnetic interference caused by peripheral electronic devices.

2. Description of the Prior Art

With the advancement of technology, electric devices, such as smart phones, tablets, and laptops, now come with many different functions.

Since most people living nowadays require a large amount of mobility everywhere they go, it is important to minimize the size of electronic products so that the users can carry them around.

Regardless of a smart phone, tablet or a laptop, they have been widely used for most people. However, the main design purpose for smart phones or tablets still focuses on entertainment. Therefore, with portable electronic devices, laptops are still the main product to provide the full range of functionality.

In general, the laptops usually come with a plurality of USB connectors mounted adjacent to the printed circuit board for the user to connect other peripheral electronic products.

However, the USB connectors mounted adjacent to the printed circuit board, though providing convenience to the user, suffer from electromagnetic waves generated, and the performances of peripheral electronic devices are greatly affect.

Thus, there is an urgent need to solve the problem of the prior art.

SUMMARY OF THE INVENTION

In view of the foregoing problems, the objective of the present invention is to provide an electrical connector, for increasing the number of spring plates on the surface of the housing of the electrical connector, as well as the contact area between the housing and the plug of the electrical connector, so as to reduce the electromagnetic interference caused by the plug to the peripheral devices.

The electrical connector according to the present invention is for an electrical connector plug to be plugged therein. The electrical connector plug comprises an iron housing, a main body disposed in the housing, and terminals installed in the main body. the electrical connector comprises: a connector main body comprising a seat, a tongue piece extending from the seat, and a plurality of grooves formed from the seat to the tongue piece; a plurality of first terminals disposed in the grooves, each of the first terminals having one end exposed from the seat; a plurality of second terminals embedded in the seat, each of the second terminals having one end exposed from the seat; and a housing having a bottom wall, two side walls extending from both sides of the bottom wall in a same direction, and a top wall connected to the side walls, wherein the top wall and the bottom wall defines an accommodating space, the housing defines a first opening and a second opening that are in communication with the accommodating space, a plurality of first giveaway spaces are formed at the top wall and the bottom wall near the first opening for accommodating a plurality of first spring plates that extend from the top wall and the bottom wall, at least one second giveaway space is formed at the top wall near the second opening for accommodating a second spring plate that extends from the top wall, the second spring plate defines a connecting portion connected with the top wall, an elastic arm integrally formed with the connecting portion, and a contact portion integrally formed with the elastic arm and extending from the elastic arm towards the accommodating space, when the connector plug is plugged into the electrical connector the contact portion of the second spring plate makes contact with the iron housing such that the contact portion is selectively received in the accommodating space or the second giveaway space, a plurality of third giveaway space are formed at the bottom wall near the second opening for accommodating a plurality of third spring plates that extend from the bottom wall, each of the third spring plates defines a connecting portion connected with the bottom wall, an elastic arm integrally formed with the connecting portion, and a contact portion integrally formed with the elastic arm and extending from the elastic arm towards the accommodating space, and when the connector plug is plugged into the electrical connector the contact portion of the third spring plate makes contact with the iron housing such that the contact portion is selectively disposed in the accommodating space or the third giveaway space.

In summary, the electrical connector proposed by the present invention involves forming a first giveaway space, a second giveaway space and a third giveaway space at the top wall and the bottom wall, allowing the first spring plate to be accommodated in the first giveaway space, the second spring plate to be accommodated in the second giveaway space, and the third spring plate to be accommodated in the third giveaway space, such that when the connector plug is plugged in the electrical connector, the contact portions of the first, second and third spring plates make contact with the iron housing of the connector plug so as to increase the contact area between the housing and the connector plug. Therefore, the shielding effect for the electromagnetic waves generated during operation which might cause interference of the peripheral electronic products is increased.

BRIEF DESCRIPTION OF THE DRAWINGS

The present invention can be more fully understood by reading the following detailed description of the preferred embodiments, with reference made to the accompanying drawings, wherein:

FIG. 1F' shows the connector plug plugged into the electrical connector in accordance with the present invention;

FIG. 1G is the comparison chart showing the shielding effect of the electromagnetic waves between the electrical connector of the present invention and that of a conventional electrical connector;

DETAILED DESCRIPTION OF THE PREFERRED EMBODIMENTS

The present invention is described in the following with specific embodiments, so that one skilled in the pertinent art can easily understand other advantages and effects of the present invention from the disclosure of the present invention.

It is to be understood that the scope of the present invention is not limited to the disclosed embodiments. On the contrary, it is intended to cover various modifications and similar arrangements. The scope of the claims, therefore, should be accorded the broadest interpretation so as to encompass all such modifications and similar arrangements. In addition, words such as "on", "top" and "a" are used to explain the preferred embodiment of the present invention only and should not limit the scope of the present invention.

Figure 1A:
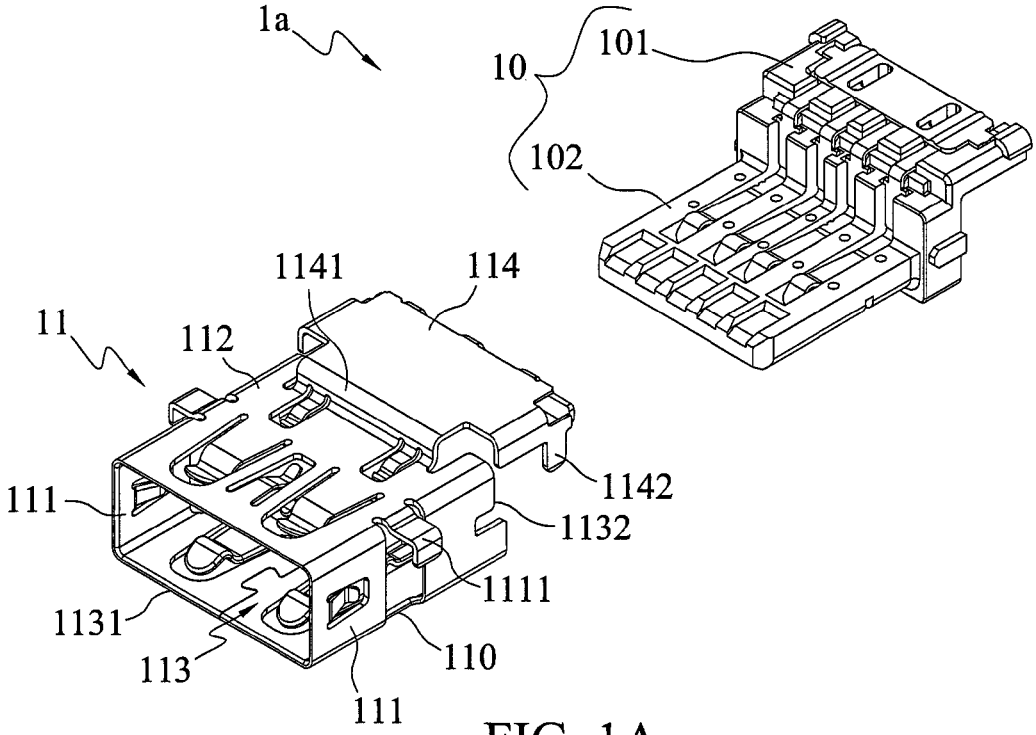
FIG. 1A is a schematic view showing a connector main body separated from a housing in accordance with a first preferred embodiment of the present invention.
Figure 1B:
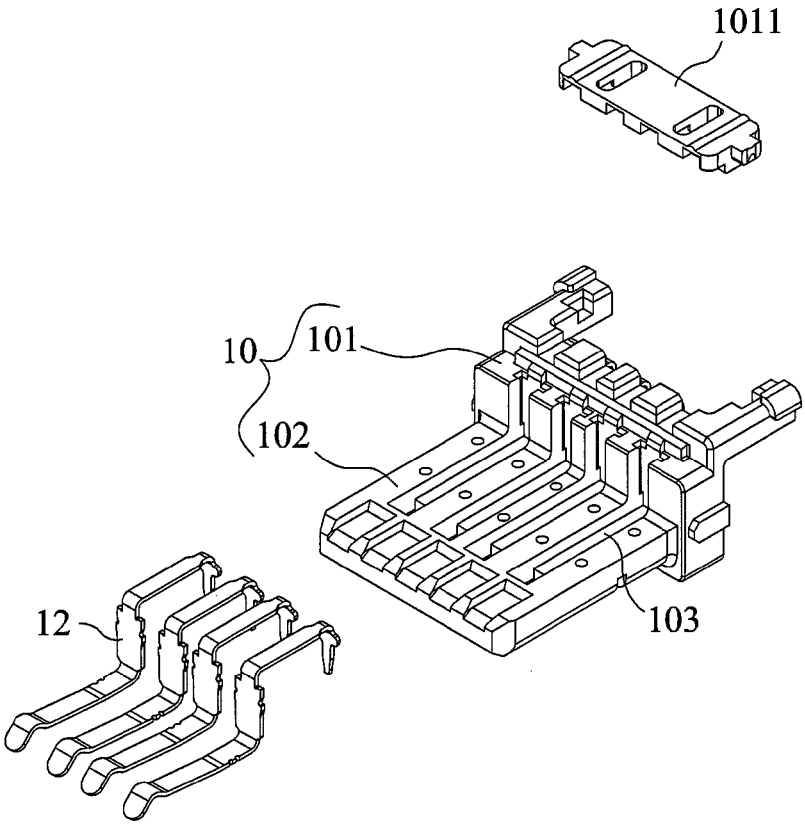
FIG. 1B is a schematic view showing a first terminal separated from a connector main body.
Figure 1C:
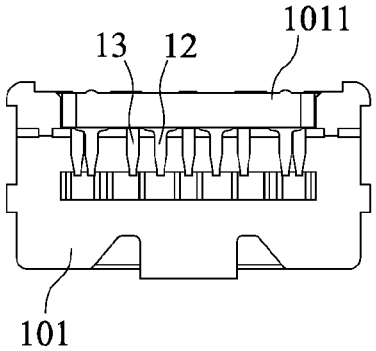
FIG. 1C is a back view of an electrical connector in accordance with the present invention.
Figure 1D:
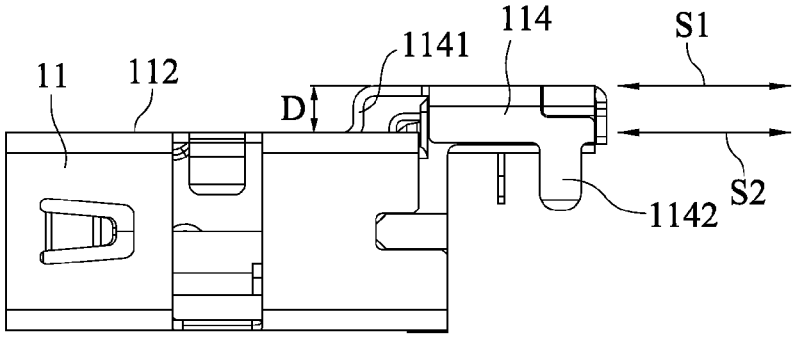
FIG. 1D is a side view of the housing of the electrical connector.

FIG. 1A is a schematic view showing a connector main body separated from a housing of a connector in accordance with a first preferred embodiment of the present invention. FIG. 1B is a schematic view showing a first terminal and the connector main body. FIG. 1C is a back view of the electrical connector. FIG. 1D is a side view of the housing of the electrical connector. The electrical connector 1*a* comprises a connector main body 10, a housing 11, a plurality of first terminals 12, and a plurality of second terminals 13.

The connector main body 10 comprises a seat 101 and a tongue piece 102 that extends from the seat 101. A plurality of paralleled grooves 103 are formed on the connector main body 10, extending from the seat 101 to the tongue piece 102. Each of the first terminals 12 is installed in each of the grooves 103, with one end of each of the first terminals 12 being exposed from the seat 101.

A plurality of second terminals 13 are embedded in the seat 101. One end of each of second terminals 13 is exposed from the seat 101. The exposed first terminals 12 and the exposed second terminals 13 are arranged in an alternate manner, as shown in FIG. 1C.

In FIG. 1A, the housing 11 has a bottom wall 110, two side walls 111, and a top wall 112 connected with the two side walls 111. The bottom wall 110, the side walls 111 and the top wall 112 of the housing 11 define the accommodating space 113, for the connector main body 10 of the electrical connector to be accommodated therein. The housing 11 defines a first opening 1131 and a second opening 1132 that are in communication with the accommodating space 113. The connector main body 10 of the electrical connector is accommodated in the accommodating space 113 of the housing 11 through the second opening 1132.

A seat cover 114 extends from the second opening 1132 of the top wall 112 of the housing 11. The seat cover 114 is located at the first plane surface S1. The top wall 112 of the housing 11 is located at the second plane surface S2. A predetermined distance D is formed between the surface of the lid cover 114 and the top wall 112, and the lid cover 114 is higher than the top wall 112 of the housing 11. Therefore, when the connector main body 10 is accommodated in the accommodating space 113, the seat cover 114 covers the corresponding seat 101. In addition, an extending portion 1141 is formed as an extension of the seat cover 114 for being connected with the top wall 112. A positioning pin 1142 is formed from two sides of the seat cover 114, extending towards the direction of the bottom wall 110, to anchor on the circuit board (not shown), and similarly a second positioning pin 1111 is formed from the two side walls 111 of the housing 11 to anchor on the circuit board.

Although the seat cover 114 is located higher than the top wall 112, the present invention is not limited thereto. The present embodiment only serves to explain the specialty of the present invention, and should not limit the scope of the present invention. The seat cover 114 can be designed as extending from the top wall 112, and the seat cover 114 and the top wall 112 can be located at the same plane. The first positioning pin 1142 on the two sides of the seat cover 114 can also be modified according to practical needs.

Besides, the seat 101 of the electrical connector 1*a* in accordance with the present invention further comprises a terminal cover 1011. When the first terminals 12 and the second terminals 13 are coupled to the seat 101, the terminal cover 1011 is used to cover the first terminals 12 and the second terminals 13, as shown in FIG. 1C.

Figure 1E:
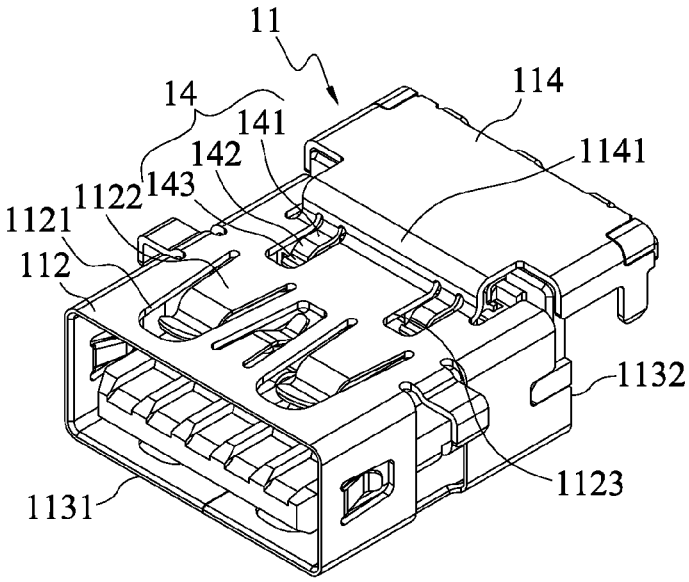
FIG. 1E is a 3D view of electrical connector in accordance with the first preferred embodiment of the present invention.
Figure 1F:
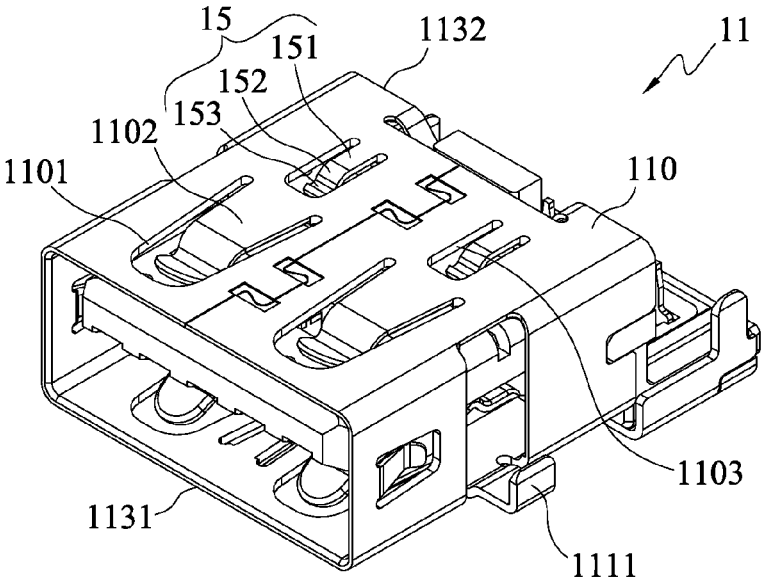
FIG. 1F is the bottom view of FIG. 1E.
Figure 1F:
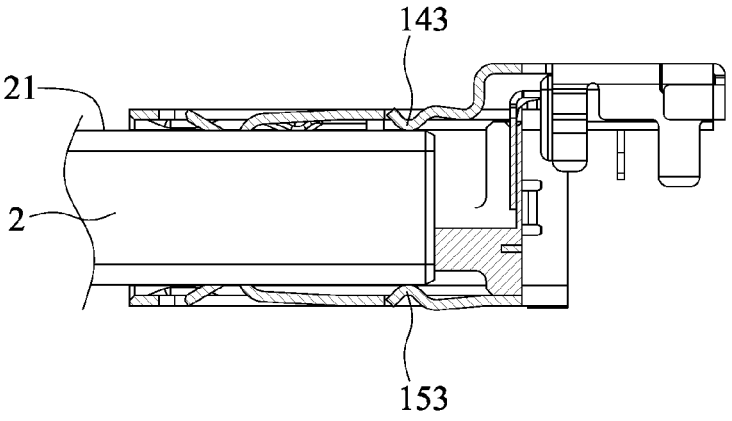

FIG. 1E is the 3D view of the first preferred embodiment of the present invention. FIG. 1F is the bottom view of FIG. 1E. A plurality of giveaway spaces 1101 are formed on the bottom wall 110 of the housing 11 near the first openings 1131. Each of the giveaway spaces 1101 is for accommodating the first spring plate 1102 extended from the bottom wall 110. Similarly, a plurality of giveaway spaces 1121 are formed on the top wall 112 of the housing 11 near the first opening 1131. Each of the second giveaway spaces 1121 is for accommodating the first spring plate 1122 extending from the top wall 112.

A second giveaway space 1123 is formed on the top wall 112 of the housing 11 near the second opening 1132, for accommodating the second spring plate 14. Each second spring plate 14 has a connecting portion 141 connected with the top wall 112. Each of the second spring plate 14 defines a connecting portion 141 connected with the top wall 112, an elastic arm 142 disposed at the second giveaway space and extending from the connecting portion 141, and a contact portion 143 defined from one end of the elastic arm towards the accommodating space 113.

In addition to the first spring plate 1102, 1122 and the second spring plate 14, a third giveaway space 1103 is formed on the bottom wall 110 of the housing 11 near the second opening 1132, for accommodating the third spring plate 15 that extends from the bottom wall 110. The third spring plate 15 defines a connecting portion 151 connected with the top wall 112, an elastic arm 152 disposed at the third giveaway space 1103 and extending from the connecting portion 151, and a contact portion 153 defined from one end of the elastic arm 152 towards the accommodating space 113.

In an embodiment, the electrical connector 1*a* is installed on the printed circuit board (not shown), to allow a connector plug 2 to be plugged therein, as shown in FIG. 1F'. Since the connector plug 2 comprises an iron housing 21, a main body, and the terminals in the main body, when the connector plug 2 is plugged into the accommodating space 113 of the housing 11 and coupled with the connector main body 10, the first spring plate 1122 and the second spring plate 14 located at the top wall and the first spring plate 1102 and third spring plate 15 located at the bottom wall 110 can make contact with the iron housing of the connector plug. For example, as shown in FIG. 1F', when the connector plug 2 is plugged into the electrical connector 1*a*, the contact portion 143 of the second spring plate 14 makes contact with the iron housing 21 such that the contact portion 143 is selectively received in the accommodating space 113 or the second giveaway space 1121. Further, when the connector plug 2 is plugged into the electrical connector 1*a*, the contact portion 153 of the third spring plate 15 makes contact with the iron housing 21 such that the contact portion 153 is selectively received in the accommodating space 113 or the third giveaway space 1103.

In comparison with the conventional electrical connector, the additional installation of the second spring plate 14 and the third spring plate15 increases the contact area between the housing 11 and the connector plug, such that the electromagnetic interference (EMI) generated during operation is directed to ground via the first spring plate 1102, 1122, second spring plate 14 and third spring plate15, thereby effectively reducing the electromagnetic interference caused to the peripheral electronic devices.

FIG. 1G is the comparison chart showing the shielding effect of the electromagnetic waves between the electrical connector of the present invention and that of a conventional electrical connector. The testing result is the noise interference value in the unit of dB which is obtained randomly on the first surface and two side surfaces of the electrical connector of the present invention and a conventional electrical connector. The larger of the noise interference value, the higher the shielding effect.

As shown in FIG. 1G, since the electrical connector 1*a* in accordance with the present invention has additional installation of the second spring plate 14 and the third spring plate 15, the contact area between the electrical connector and the electrical connector plug is greatly increased, and thereby achieving a better electromagnetic shielding effect.

Figure 2A:
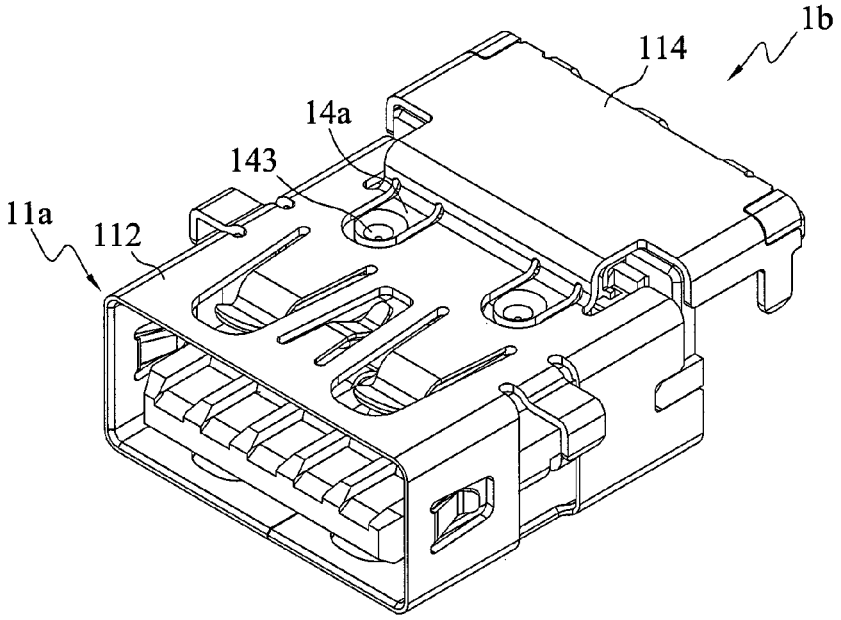
FIG. 2A is a 3D view of an electrical connector in accordance with a second preferred embodiment of the present invention.
Figure 2B:
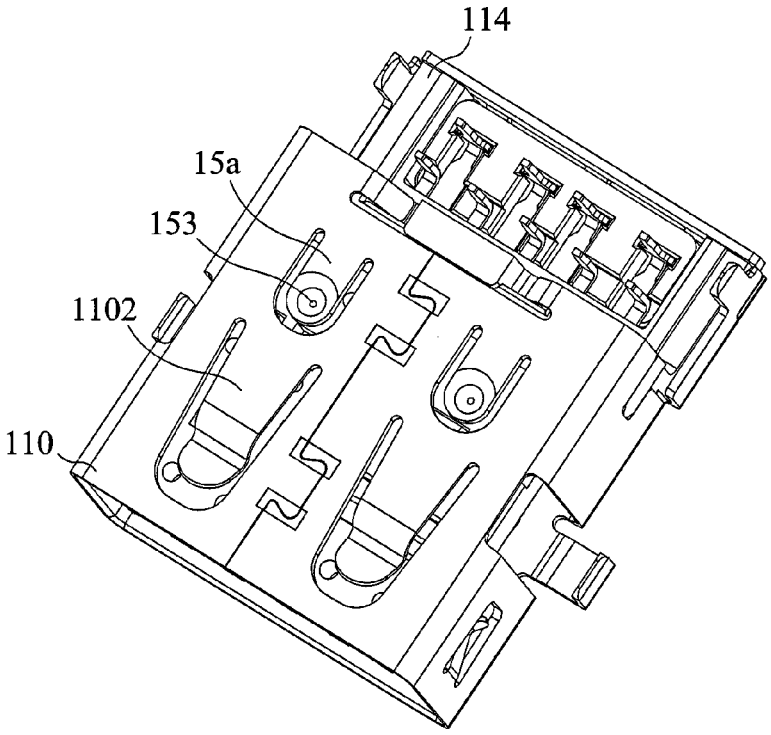
FIG. 2B is the bottom view of FIG. 2A.

FIG. 2A is the 3D view of an electrical connector in accordance with a second preferred embodiment of the present invention. FIG. 2B is a bottom view of FIG. 2A. The second embodiment differs from the first embodiment in that the second spring plate 14*a* and third spring plate 15*a* of the housing 11*a* of the electrical connector 1*b* have different structures.

In the second embodiment, the contact portion 143 of the second spring plate 14*a* and the contact portion 153 of the third spring plate 15*a* are circular. Therefore, not only the contact area between the contact portion 143, 153 and the iron housing is increased, the gap between the second spring plate 14*a* and the top wall 112, between the third spring plate 15*a* and the bottom wall 110 is further reduced. Compared with the conventional spring plate where it must be bent slightly to form the contact portion, causing undesirably larger gap between the spring plate and the top wall 112, and between the spring plate and the bottom wall 110. The circular contact portion 143, 153 can still make contact with the iron housing without the need of bending, thereby reducing the gap between the contact portion 143, 153 and the top wall 112, bottom wall 110, and as a result desirably reducing the electromagnetic interference caused to the peripheral electronic devices, and improving the shielding effect of the electromagnetic interference.

Although the contact portion 143 of the second spring plate 14*a* and the contact portion 153 of the third spring plate 15*a* are both circular, it is applicable to selectively choose one of the contact portion 143 or 153 to be circular, instead of two.

Figure 3:
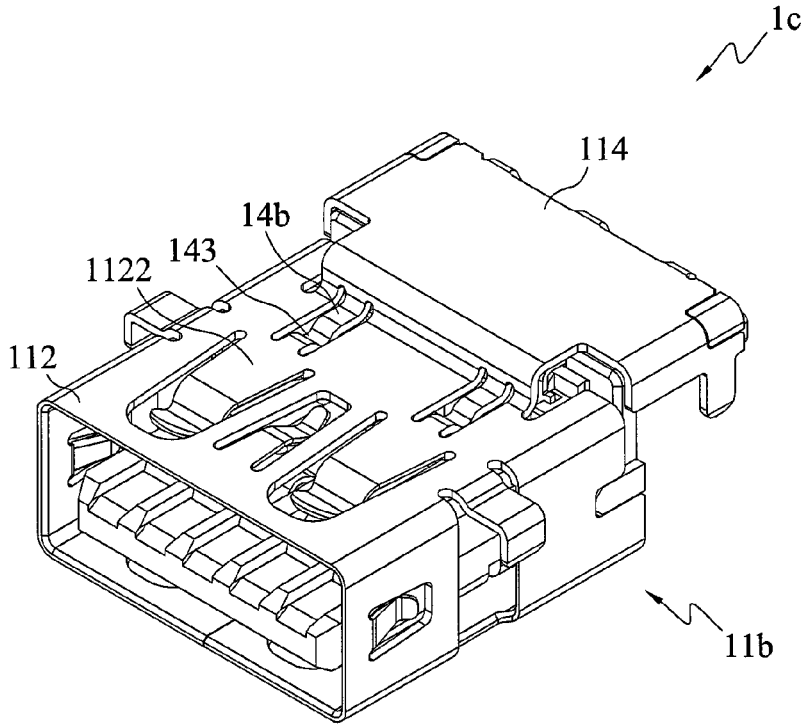
FIG. 3 is a 3D view of an electrical connector in accordance with a third preferred embodiment of the present invention.

FIG. 3 is the 3D view of an electrical connector in accordance with a third preferred embodiment of the present invention. The third embodiment differs from the first embodiment in that the second spring plate 14*b* has contact portion 143, the end of which is connected to the top wall 112, and the two ends of the second spring plate 14*b* of the third embodiment are connected with the top wall 112 of the housing 11*b*.

Figure 4A:
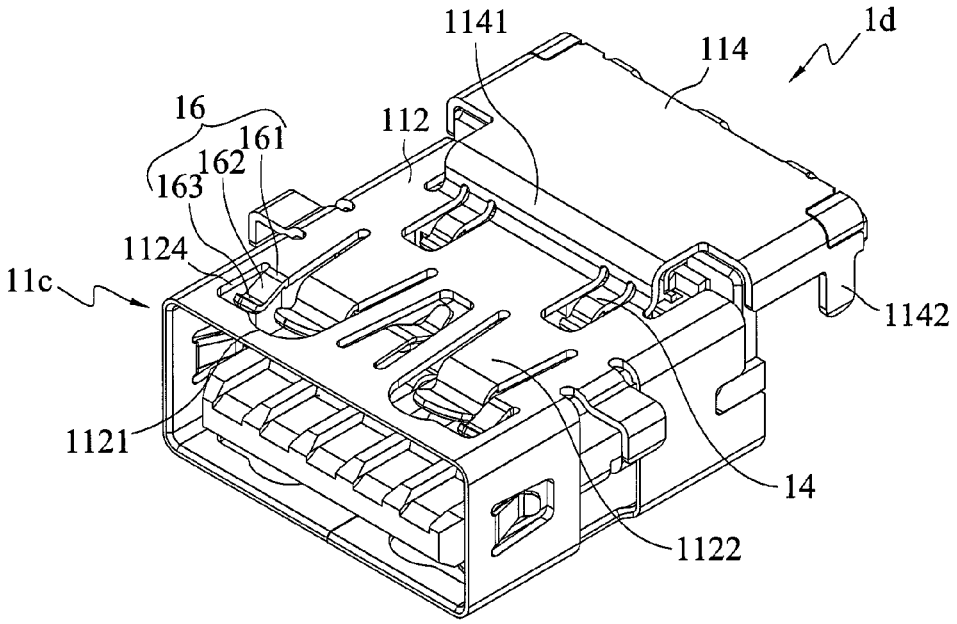
FIG. 4A is a 3D view of an electrical connector in accordance with a fourth preferred embodiment of the present invention.
Figure 4B:
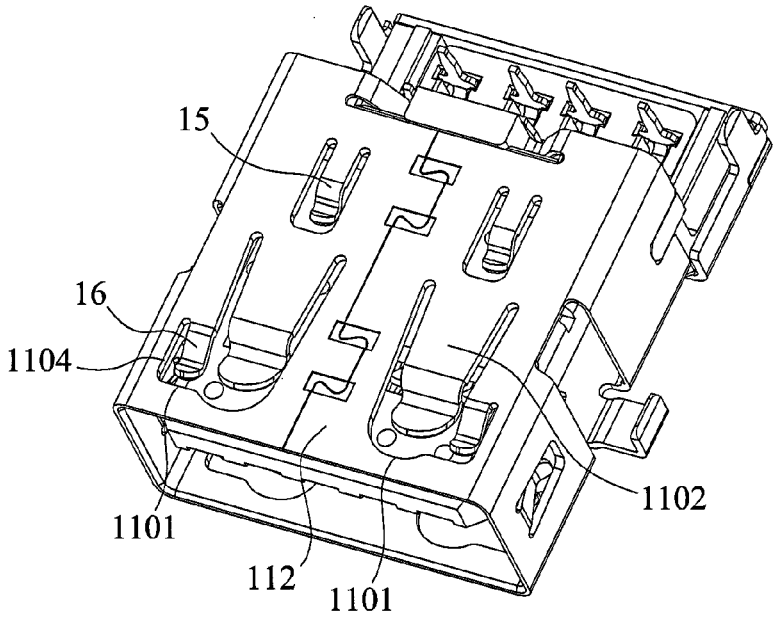
FIG. 4B is the bottom view of the electrical connector in accordance with the fourth preferred embodiment of the present invention.

FIG. 4A is a 3D view of an electrical connector in accordance with a fourth preferred embodiment of the present invention. FIG. 4B is the bottom view of the electrical connector in accordance with the fourth preferred embodiment of the present invention. The fourth differs from the first embodiment in that in fourth giveaway spaces 1104, 1124 are further formed at the bottom wall 110 and the top wall 112 which are connected with the first giveaway spaces 1101, 1121, to accommodate the fourth spring plate 16 that extends from the bottom wall 110 and the top wall 112.

The fourth spring plate 16 defines a connecting portion 161, an elastic arm 162 disposed at the fourth giveaway space 1104 and extending from the connecting portion 161, and a contact portion 163 defined from one end of the elastic arm 162 towards the accommodating space 13, such that the contact portion 163 located selectively in the fourth giveaway space 1104, 1124 of the accommodating space 13 can make contact with the iron housing, which is selectively located at the fourth giveaway space 1104, 1124 of the accommodating space 13.

The additionally installed fourth spring plate 16 of the fourth embodiment increases the contact area between the electrical connector 1*d* and the electrical connector plug, thereby enhancing the shielding effect of the electrical connector 1*d* for electromagnetic interference.

Figure 5A:
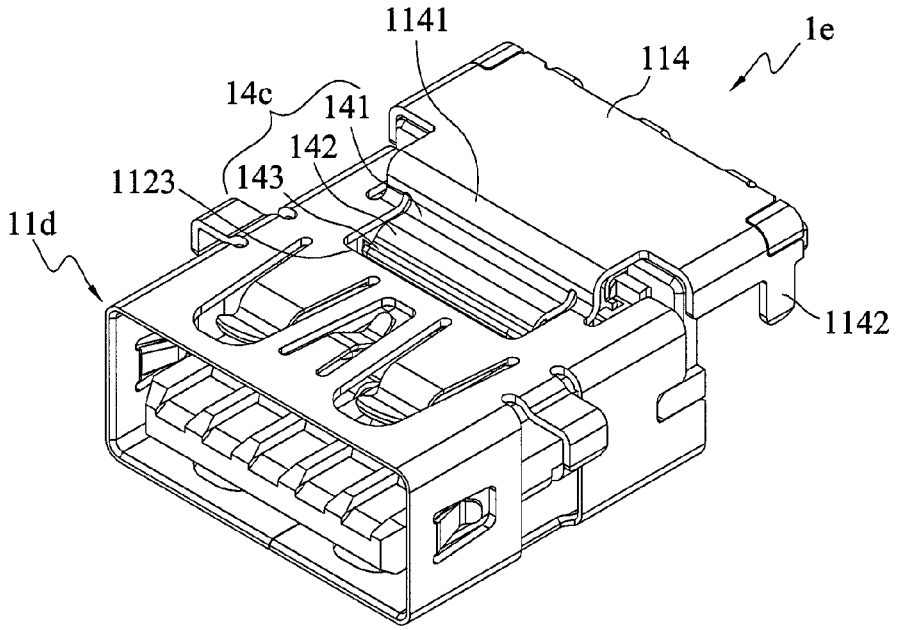
FIG. 5A is a 3D view of an electrical connector in accordance with a fifth preferred embodiment of the present invention.
Figure 5B:
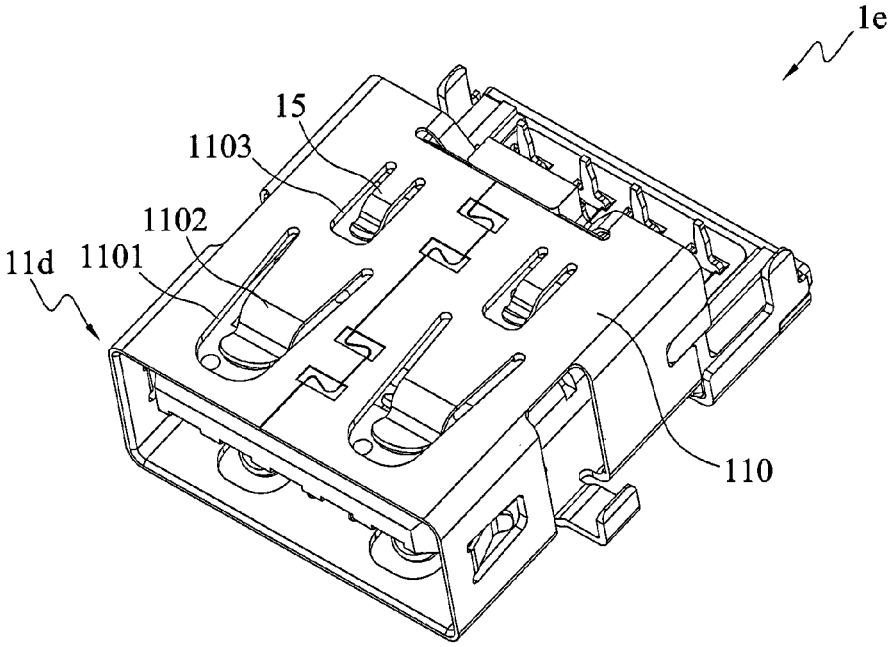
FIG. 5B is the bottom view of FIG. 5A.

FIG. 5A is a 3D view of an electrical connector in accordance with a fifth preferred embodiment of the present invention. FIG. 5B is the bottom view of FIG. 5A. The fifth embodiment differs from the first embodiment in that in the fifth embodiment only one second spring plate 14*c* is disposed in the second giveaway space 1123 of the top wall 112 of the housing 11*d*. Each of the second spring plates 14*c* defines a connecting portion 141 connected with the top wall 112, an elastic arm 142 disposed at the second giveaway space 1123 and extending from the connecting portion 141, and a contact portion 143 defined from one end of the elastic arm 142. The second spring plate 14*c* of the fifth embodiment is a single plate structure, such that the contact area between the electrical connector plug and the electrical connector of the present invention is increased.

Figure 6:
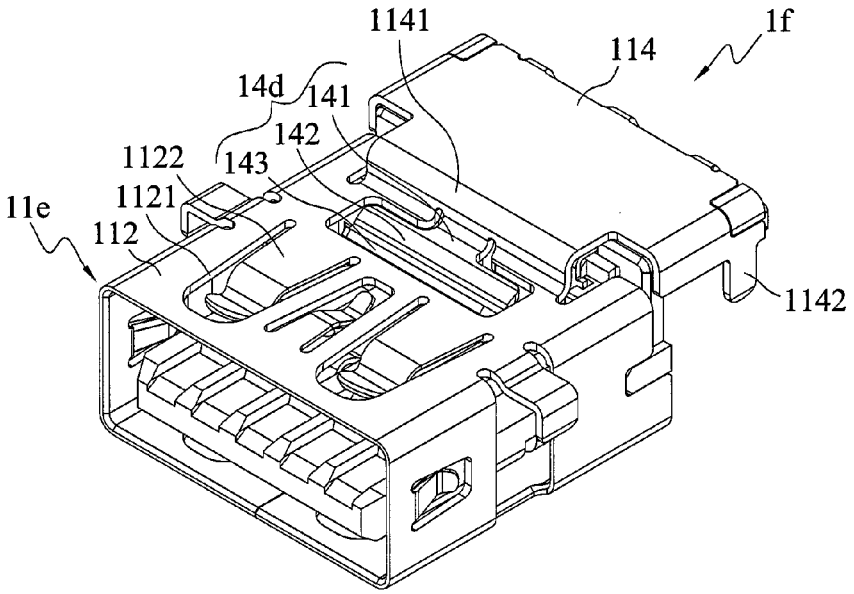
FIG. 6 is the 3D view of an electrical connector in accordance with a sixth preferred embodiment of the present invention.

FIG. 6 is the 3D view of an electrical connector in accordance with a sixth preferred embodiment of the present invention. The sixth embodiment differs from the first embodiment in that in the sixth embodiment only one second spring plate 14*c* is formed in the second giveaway space 1123 of the top wall 112 of the housing 11*d*. Each of the second spring plates 14*c* defines a connecting portion 141 connected with the top wall 112, an elastic arm 142 disposed at the second giveaway space 1123 and extending from the connecting portion 141, and a contact portion 143 defined from one end of the elastic arm 142. The second spring plate 14*c* of the sixth embodiment is a single plate structure, such that the contact area between the electrical connector plug and the electrical connector of the present invention is increased. The difference is that in the electrical connector 1*e* of the fifth preferred embodiment, an connecting portion 141 is formed as an extension from the end of the elastic arm 142 of the second spring plate 14*c* of the housing 11*e*, connecting with the top wall 112, and in the present embodiment, the housing 11*e* of the present embodiment only connects to the top wall via part of the connecting portion 141 on the end of the elastic arm 142 of the second spring plate 14*d*.

In comparison with the electrical connector 1*e* of FIG. 5A, wherein the connecting portion 141 is formed as an extension of the end part of the elastic arm 142 of the second spring pate 14*c* to connect with the top wall112, and therefore the second spring plate 14*c* has a larger arm of force. As a result when plugging or unplugging the connector plug, owing to the larger arm of force, the overall elasticity of the second spring plate 14*c* as well as friction between the electrical connector plug and the second spring plate 14*c* are larger, and as a result, the electrical connector plug is coupled more tightly with the electrical connector 1*e* of the fifth preferred embodiment and more force is required to plug or unplug from the electrical connector 1*e*. On the other hand in the present embodiment, the connecting portion 141 is an extension of only a part of the elastic arm 142 of the second spring plate 14*d*, therefore the arm of force as well as the elasticity of the present embodiment is smaller than the fifth embodiment, allowing the connector plug to be less tightly coupled with the electrical connector 1*f* of the present embodiment.

Figure 7:
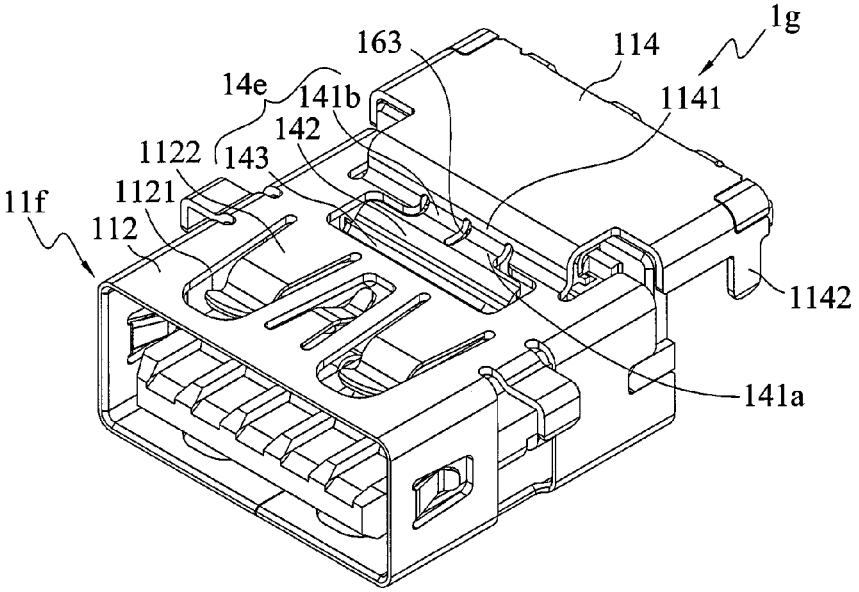
FIG. 7 is the 3D view of an electrical connector in accordance with a seventh preferred embodiment of the present invention.

FIG. 7 is an electrical connector of a seventh preferred embodiment of the present invention. The seventh embodiment differs from the sixth embodiment in that in the seventh embodiment the end of the elastic arm 142 of the second spring plate 14*e* of the housing 11*f* defines two connecting portions 141*a* and 141*b* which are both coupled to the elastic arm 142, and the other ends are coupled to the extending portion 1141 of the seat cover 114.

Compared with the fifth preferred embodiment, the second spring plate 14*e* of the seventh embodiment defines two connecting portions 141*a* and 151*b*, which is different from the fifth preferred embodiment as a one-piece structure. As a result, the arm of force as well as the elasticity of the present embodiment are less than that of the fifth embodiment, such that the connector plug is less tightly coupled with the electrical connector 1*f* of the present embodiment, in comparison with that of the fifth embodiment.

In comparison with the sixth preferred embodiment, in which the connecting portion 141 is formed as an extension of a part of the end of the elastic arm 142, in the present embodiment, two connecting portions 141*a* and 141*b* are formed at the end of the elastic arm 142, and therefore has larger arm of force and elasticity than that of the sixth embodiment, as a result, in the present embodiment, the electrical connector plug is coupled more tightly with the electrical connector and more force is required to plug or unplug from the electrical connector 1*e*, compared to that of the sixth embodiment.

Figure 8:
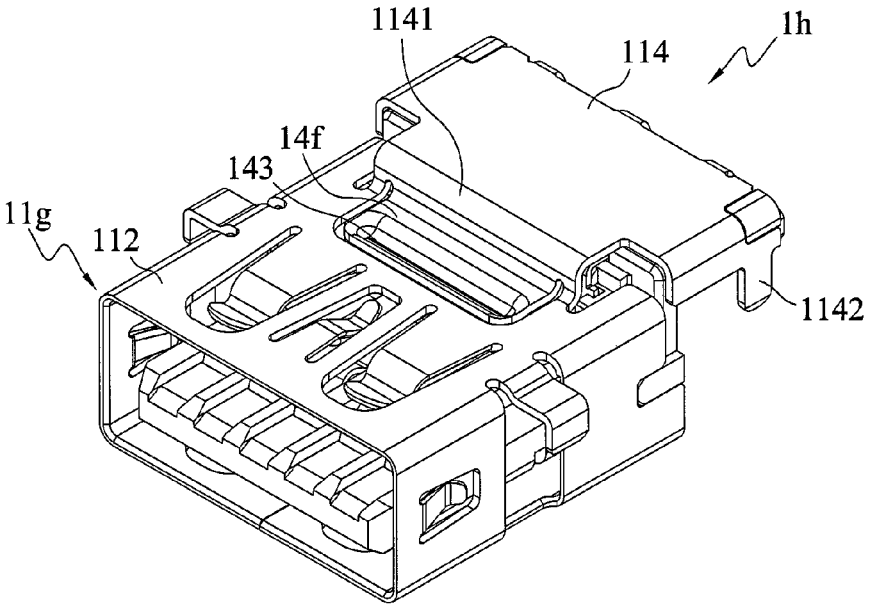
FIG. 8 is the 3D view of an electrical connector in accordance with an eighth preferred embodiment of the present invention.

FIG. 8 is the 3D view of an electrical connector in accordance with an eighth preferred embodiment of the present invention. The difference is that in the eighth embodiment, the second spring plate 14*f* of the housing 11*g* of the electrical connector 1*h* is a single plate structure, and the connecting portion 143 of the second spring plate 14*f* is in a long oval shape. The long oval connecting portion 143 increases the contact area between the electrical connector 1*h* and the connector plug, and reduces the gap between the second spring plate 14*f* and the top wall 112, thereby enhancing the shielding effect of the electromagnetic waves and reducing the electromagnetic interference to the peripheral electronic devices.

It should be noted, from the third embodiment to the eighth embodiment, the emphasis is made to describe the structural differences between the second spring plate 14*b*, 14*c*, 14*d*, 14*e*, and 14*f*. However, the structure of the contact portion 153 of the third spring plate 15 of the foregoing embodiment is not limited to a particular kind, such as that of the first embodiment or circular shape of the second embodiment.

The present invention has been described using exemplary preferred embodiments. However, it is to be understood that the scope of the present invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. An electrical connector, for a connector plug to be plugged therein, the connector plug comprising an iron housing, a main body disposed in the housing, and terminals installed in the main body, the electrical connector comprising:

a connector main body comprising a seat, a tongue piece extending from the seat, and a plurality of grooves formed from the seat to the tongue piece;

a plurality of first terminals disposed in the grooves, each of the first terminals having one end exposed from the seat;

a plurality of second terminals embedded in the seat, each of the second terminals having one end exposed from the seat; and a housing having a bottom wall, two side walls extending from both sides of the bottom wall in a same direction, and a top wall connected to the side walls;

wherein the top wall and the bottom wall defines an accommodating space, the housing defines a first opening and a second opening that are in communication with the accommodating space, a plurality of first giveaway spaces are formed at the top wall and the bottom wall near the first opening for accommodating a plurality of first spring plates that extend from the top wall and the bottom wall, at least one second giveaway space is formed at the top wall near the second opening for accommodating a second spring plate that extends from the top wall, the second spring plate has a connecting portion connected with the top wall, an elastic arm integrally formed with the connecting portion, and a contact portion integrally formed with the elastic arm and extending from the elastic arm towards the accommodating space, when the connector plug is plugged into the electrical connector the contact portion of the second spring plate makes contact with the iron housing such that the contact portion is selectively received in the accommodating space or the second giveaway space, a plurality of third giveaway spaces are formed at the bottom wall near the second opening for respectively accommodating a plurality of third spring plates that extend from the bottom wall, each of the third spring plates has a connecting portion connected with the bottom wall, an elastic arm integrally extended from the connecting portion, and a contact portion integrally formed with the elastic arm and extending towards the accommodating space, and when the connector plug is plugged into the electrical connector, the contact portion of the third spring plate makes contact with the iron housing such that the contact portion is selectively received in the accommodating space or the third giveaway space.

2. The electrical connector of claim 1, further comprising a seat cover that extends from the top wall of the second opening for covering the seat.

3. The electrical connector of claim 2, further comprising at least one positioning pin coupled to two sides of the seat and extends towards the bottom wall.

4. The electrical connector of claim 2, wherein an extending portion is formed on the top wall and extends from the seat cover.

5. The electrical connector of claim 1, wherein the contact portion of the second spring plate is in a long oval shape.

6. The electrical connector of claim 1, wherein the iron housing has two second giveaway spaces, and each of which has a second spring plate extending from the top wall to be accommodated therein.

7. The electrical connector of claim 6, wherein the contact portion of each of the second spring plates is circular.

8. The electrical connector of claim 6, wherein the top wall is connected to one end of each of the second spring plates that has a contact portion.

9. The electrical connector of claim 1, further comprising a fourth giveaway space formed near the side wall at a side of each of the giveaway spaces of the top wall, and a fourth spring plate accommodated in the fourth giveaway space, wherein the fourth spring plate has a connecting portion connected with the top wall, an elastic arm integrally formed with the connecting portion, and a contact portion integrally formed with the elastic arm and extending towards the accommodating space, and when the connector plug is plugged in the electrical connector, the contact portion makes contact with the iron housing such that the contact portion is selectively accommodated in the accommodating space or the fourth giveaway space.

10. The electrical connector of claim 1, wherein the iron housing has two second positioning pins extending from two sides of the housing, respectively.

11. The electrical connector of claim 1, wherein the contact portion of each of the third spring plates is circular.

12. The electrical connector of claim 1, wherein the seat further comprises a terminal cover that is detachably coupled with the seat for covering the first terminals and the second terminals.

13. The electrical connector of claim 1, wherein the first terminals and the second terminals are arranged in an alternate manner.

14. The electrical connector of claim 1, wherein the connecting portion of the second spring plate is formed by extending a whole end part of the elastic arm of the second spring plate.

15. The electrical connector of claim 1, wherein the connecting portion of the second spring plate is formed by extending a portion of an end part of the elastic arm of the second spring plate.

16. The electrical connector of claim 1, wherein the second spring plate has two connecting portions that are coupled to an end part of the elastic arm of the second spring plate.

* * * * *